US010714906B1

(12) United States Patent
Ban

(10) Patent No.: US 10,714,906 B1
(45) Date of Patent: Jul. 14, 2020

(54) SPARK PLUG

(71) Applicant: NGK Spark Plug Co., Ltd., Nagoya-shi, Aichi (JP)

(72) Inventor: Kenji Ban, Nagoya (JP)

(73) Assignee: NGK Spark Plug Co., Ltd., Nagoya-shi (JP)

( * ) Notice: Subject to any disclaimer, the term of this patent is extended or adjusted under 35 U.S.C. 154(b) by 0 days.

(21) Appl. No.: 16/843,200

(22) Filed: Apr. 8, 2020

(30) Foreign Application Priority Data

Apr. 16, 2019 (JP) ..... 2019-077492

(51) Int. Cl.

| | |
|---|---|
| ***H01T 13/39*** | (2006.01) |
| ***H01T 13/32*** | (2006.01) |
| ***H01T 21/02*** | (2006.01) |
| ***H01T 13/06*** | (2006.01) |
| ***H01T 13/46*** | (2006.01) |

(52) U.S. Cl.
CPC ..... *H01T 13/39* (2013.01); *H01T 13/06* (2013.01); *H01T 13/32* (2013.01); *H01T 13/467* (2013.01); *H01T 21/02* (2013.01)

(58) Field of Classification Search
CPC ..... H01T 13/39; H01T 13/06; H01T 13/32; H01T 13/467; H01T 21/02
See application file for complete search history.

(56) References Cited

U.S. PATENT DOCUMENTS 10,020,640 B2 * 7/2018 Niessner ..... B22F 3/225

FOREIGN PATENT DOCUMENTS

JP 2006-144648 A 6/2006

* cited by examiner

*Primary Examiner* — Anne M Hines
(74) *Attorney, Agent, or Firm* — Kusner & Jaffe

(57) ABSTRACT

A spark plug capable of facilitating the growth of a flame kernel. The spark plug including a metal shell; a center electrode retained in the metal shell in an insulated manner; a ground electrode disposed such that a spark gap is formed between the center electrode and an end portion of the ground electrode; and a plug cap that covers the center electrode and the end portion of the ground electrode from the front in a region in front of the metal shell and in which a through hole is formed. An inner surface of the plug cap in a region in front of a back end of the end portion of the ground electrode and an inner surface of the through hole each have an arithmetical mean roughness of less than or equal to 6.3 μm.

8 Claims, 5 Drawing Sheets

SPARK PLUG

FIELD OF THE INVENTION

The present invention relates to a spark plug including a pre-chamber for a combustion chamber of an engine.

BACKGROUND OF THE INVENTION

A spark plug including a pre-chamber for a combustion chamber of an engine is known. For example, see Japanese Unexamined Patent Application Publication No. 2006-144648 ("PTL 1). This type of spark plug includes a plug cap that is connected to a metal shell and that has a through hole. The plug cap is exposed in the combustion chamber so that the pre-chamber is provided in the combustion chamber. Combustible air-fuel mixture flows into the plug cap from the combustion chamber through the through hole. The spark plug ignites the combustible air-fuel mixture that has reached a spark gap, so that the combustible air-fuel mixture is combusted to generate an expansion pressure that causes a gas flow including flame to be injected into the combustion chamber through the through hole. The combustible air-fuel mixture in the combustion chamber is combusted by the injected flow of flame.

However, according to the technology disclosed in PTL 1, when variation in disruption of the combustible air-fuel mixture that has flowed into the plug cap from the combustion chamber through the through hole increases, the combustible air-fuel mixture does not easily reach the spark gap as designed. Accordingly, growth of a flame kernel generated in the spark gap may be suppressed and the combustion stability may be reduced.

SUMMARY OF THE INVENTION

The present invention has been made to solve the above-described problem, and an object of the present invention is to provide a spark plug capable of facilitating the growth of a flame kernel.

To achieve the above-described object, a spark plug according to the present invention includes a metal shell having a tubular shape and extending along an axial line in a direction from front to back; a center electrode retained in the metal shell in an insulated manner; a ground electrode electrically connected to the metal shell and disposed such that a spark gap is formed between the center electrode and an end portion of the ground electrode; and a plug cap that covers the center electrode and the end portion of the ground electrode from the front in a region in front of the metal shell and in which a through hole is formed. An inner surface of the plug cap in a region in front of a back end of the end portion of the ground electrode and an inner surface of the through hole each have an arithmetical mean roughness of less than or equal to 6.3 μm.

According to the spark plug of the present invention, the inner surface of the plug cap in the region in front of the back end of the end portion of the ground electrode and the inner surface of the through hole each have an arithmetical mean roughness of less than or equal to 6.3 μm. Therefore, variation in disruption of the flow of combustible air-fuel mixture that enters the plug cap from a combustion chamber through the through hole, flows along the inner surface of the plug cap, and reaches the spark gap can be reduced. Accordingly, the combustible air-fuel mixture easily reaches the spark gap as designed, which facilitates the growth of a flame kernel.

When the arithmetical mean roughness of the inner surface of the plug cap and the arithmetical mean roughness of the inner surface of the through hole are less than or equal to 1.6 μm, the variation in the disruption of the flow of the combustible air-fuel mixture can be further reduced, so that the growth of the flame kernel can be further facilitated. When the arithmetical mean roughness of the inner surface of the plug cap and the arithmetical mean roughness of the inner surface of the through hole are less than or equal to 0.8 μm, the effect can be enhanced.

When the metal shell has an external thread on a back portion of an outer surface of the metal shell and is welded to a back end portion of the plug cap in a region in front of the external thread, an outer surface of the plug cap in a region excluding a welded portion between the plug cap and the metal shell may have an arithmetical mean roughness of less than or equal to 6.3 μm. In such a case, the variation in the disruption of the flow of the combustible air-fuel mixture that flows along the outer surface of the plug cap and enters the through hole from the combustion chamber can be reduced. As a result, the variation in the disruption of the flow of the combustible air-fuel mixture that flows through the through hole and reaches the spark gap can be further reduced. This further facilitates the growth of the flame kernel.

When the plug cap has an external thread on a back portion of an outer surface of the plug cap, the outer surface of the plug cap in a region in front of a front end of the external thread may have an arithmetical mean roughness of less than or equal to 6.3 μm. In such a case, the variation in the disruption of the flow of the combustible air-fuel mixture that flows along the outer surface of the plug cap and enters the through hole from the combustion chamber can be reduced. As a result, the variation in the disruption of the flow of the combustible air-fuel mixture that flows through the through hole and reaches the spark gap can be further reduced. This further facilitates the growth of the flame kernel.

When the arithmetical mean roughness of the outer surface of the plug cap is less than or equal to 1.6 μm, the variation in the disruption of the flow of the combustible air-fuel mixture can be further reduced, so that the growth of the flame kernel can be further facilitated. When the arithmetical mean roughness of the outer surface of the plug cap is less than or equal to 0.8 μm, the effect can be enhanced.

When an arithmetical mean roughness measured on an intersection line between a plane parallel to the axial line and a surface of the plug cap is in the above-described ranges, the effect of reducing the variation in the disruption of the flow from the through hole toward the spark gap can be enhanced. As a result, the growth of the flame kernel can be further facilitated.

DETAILED DESCRIPTION OF THE INVENTION

Figure 1:
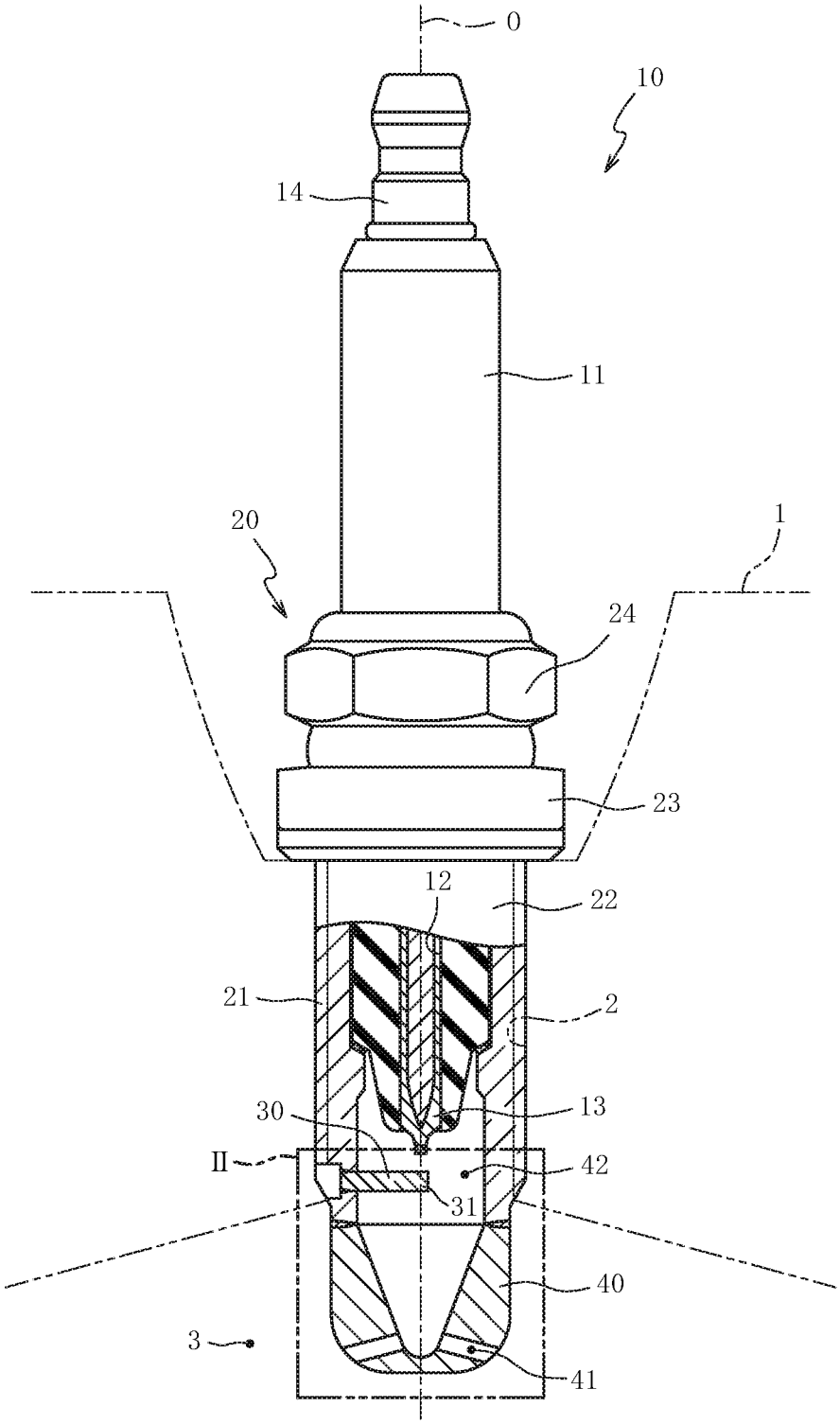
FIG. 1 is a partially sectioned view of a spark plug according to a first embodiment.

Preferred embodiments of the present invention will now be described with reference to the accompanying drawings. FIG. 1 is a partially sectioned view of a spark plug 10 according to a first embodiment. The bottom of FIG. 1 is defined as the front of the spark plug 10, and the top of FIG. 1 is defined as the back of the spark plug 10. This also applies to FIGS. 2, 4, and 5. FIG. 1 shows a cross section of a front end portion of the spark plug 10 including an axial line O. As illustrated in FIG. 1, the spark plug 10 includes an insulator 11, a center electrode 13, a metal shell 20, a ground electrode 30, and a plug cap 40.

The insulator 11 is a substantially cylindrical member having an axial hole 12 that extends along the axial line O, and is made of a ceramic, such as alumina, having good mechanical characteristics and high insulation properties at high temperatures. The center electrode 13 is disposed in a front region of the axial hole 12 in the insulator 11. The center electrode 13 is electrically connected to a metal terminal 14 in the axial hole 12. The metal terminal 14 is a rod-shaped member to which a high-voltage cable (not shown) is connected, and is made of a conductive metal material (for example, low-carbon steel). The metal terminal 14 is fixed to the back end of the insulator 11.

The metal shell 20 is a substantially cylindrical member made of a conductive metal material (for example, low-carbon steel). The metal shell 20 includes a front end portion 22 having an external thread 21 formed on an outer peripheral surface thereof, a seating portion 23 that is adjacent to and behind the front end portion 22, and a tool engagement portion 24 provided behind the seating portion 23. The external thread 21 is screwed into a threaded hole 2 in an engine 1. The seating portion 23 is a portion that seals a clearance between the threaded hole 2 in the engine 1 and the external thread 21, and has an outer diameter greater than the outer diameter of the external thread 21. The tool engagement portion 24 engages with a tool, such as a wrench, used to screw the external thread 21 into the threaded hole 2 in the engine 1.

The ground electrode 30 is a rod-shaped member made of a metal material containing, for example, Pt as a main component. In the present embodiment, the ground electrode 30 is disposed at a position where the external thread 21 is provided, and extends through the front end portion 22 to project into the inside of the front end portion 22. One end portion 31 of the ground electrode 30 faces the center electrode 13. The plug cap 40 is connected to the front end portion 22 of the metal shell 20 in a region in front of the external thread 21. The main component of the ground electrode 30 is not limited to the above-described element, and other elements may, of course, be the main component. Examples of other elements include Ni and Ir.

The plug cap 40 is a portion that covers the center electrode 13 and the end portion 31 of the ground electrode 30 from the front. The plug cap 40 is made of a metal material containing, for example, Fe as a main component. The plug cap 40 has at least one through hole 41 in a region in front of the ground electrode 30. In the present embodiment, a plurality of through holes 41 are formed in the plug cap 40. When the spark plug 10 is installed by screwing the external thread 21 into the threaded hole 2 in the engine 1, the plug cap 40 is exposed in a combustion chamber 3 of the engine 1. The through holes 41 connect a pre-chamber 42, which is surrounded by the metal shell 20 and the plug cap 40, to the combustion chamber 3. The main component of the plug cap 40 is not limited to the above-described element, and other elements may, of course, be the main component. Examples of other elements include Ni and Cu.

Figure 2:
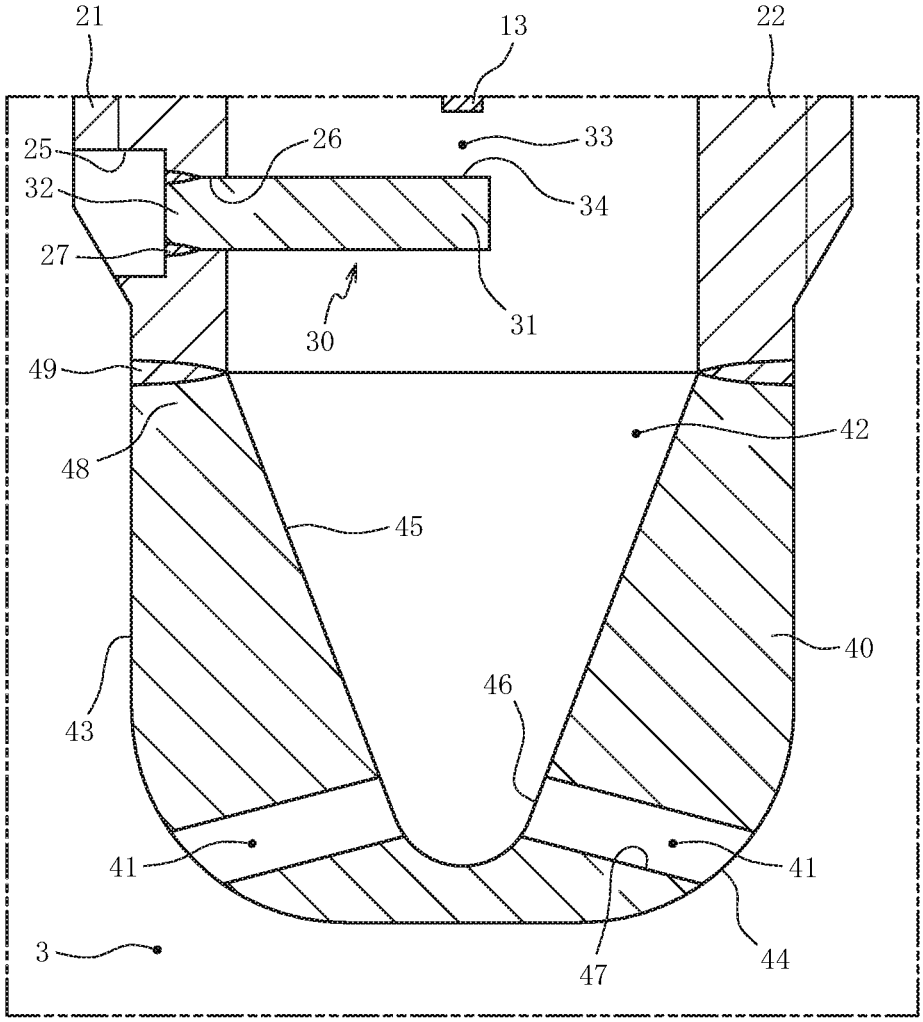
FIG. 2 is an enlarged sectional view of part II of the spark plug shown in FIG. 1.

FIG. 2 is an enlarged sectional view of part II of the spark plug 10 shown in FIG. 1 including the axial line O. The front end portion 22 of the metal shell 20 has a recess 25 that is recessed radially inward in a region where the external thread 21 is provided. The front end portion 22 also has a hole 26, which is thinner than the recess 25, in a region radially inside the recess 25. The hole 26 extends through the front end portion 22 in a radial direction. The other end portion 32 of the ground electrode 30 is inserted in the hole 26 and joined to the front end portion 22 by a welded portion 27. A spark gap 33 is formed between the end portion 31 of the ground electrode 30 and the center electrode 13. Since the ground electrode 30 is joined to the metal shell 20 in the region where the external thread 21 is provided, heat is transferred from the ground electrode 30 to the engine 1 through the external thread 21.

Each through hole 41 has an outer open end 44 in an outer surface 43 of the plug cap 40 and an inner open end 46 in an inner surface 45 of the plug cap 40. In the present embodiment, the entirety of the inner surface 45 of the plug cap 40, which is cone-shaped, is positioned in front of a back end 34 of the end portion 31 of the ground electrode 30. A cross-sectional area of the pre-chamber 42 surrounded by the inner surface 45 of the plug cap 40 along a plane perpendicular to the axial line O increases with increasing distance in the direction from front to back.

The inner open end 46 of each through hole 41 is positioned in front of the back end 34 of the end portion 31 of the ground electrode 30. Each through hole 41 has an inner surface 47 that is inclined toward the front in the direction from the inner open end 46 to the outer open end 44. A back end portion 48 of the plug cap 40 is joined to the front end portion 22 of the metal shell 20 by a welded portion 49.

Figure 3:
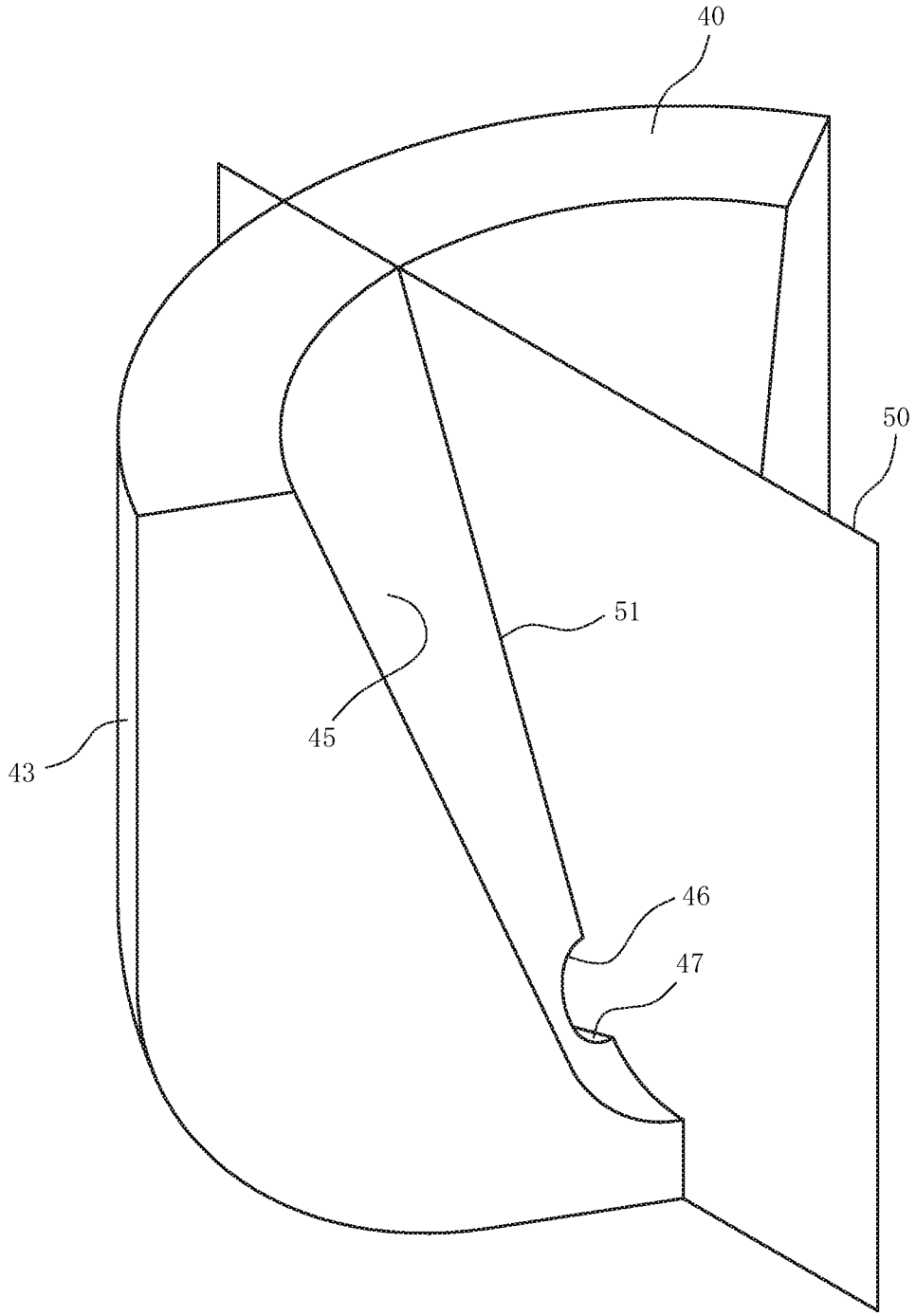
FIG. 3 is a perspective view of the plug cap sectioned along a plane that is parallel to an axial line.

FIG. 3 is a perspective view of the plug cap 40 sectioned along a plane 50 that is parallel to the axial line (see FIG. 1). FIG. 3 illustrates a portion of the circumference of the plug cap 40. The plug cap 40 is subjected to, for example, magnetic fluid polishing or lapping to adjust the surface roughnesses of the outer surface 43, the inner surface 45, and the inner surface 47 of each through hole 41. An arithmetical mean roughness Ra of each of the outer surface 43 and the inner surface 45 of the plug cap 40 and the inner surface 47 of each through hole 41 is measured on an intersection line 51 between the plane 50 parallel to the axial line O and a surface of the plug cap 40.

The arithmetical mean roughness Ra is determined from a curve (not shown) obtained by, for example, detecting the intersection line 51 by using an optical non-contact surface roughness measurement device and removing short-wavelength and long-wavelength components of the intersection line 51 by using a filter in accordance with JIS B0601:2013. An evaluation length of the arithmetical mean roughness is determined in accordance with JIS B0633:2001.

The arithmetical mean roughnesses of the outer surface 43 and the inner surface 45 of the plug cap 40 and the inner surface 47 of each through hole 41 are less than or equal to 6.3 μm. Preferably, the arithmetical mean roughnesses of the outer surface 43 and the inner surface 45 of the plug cap 40 and the inner surface 47 of each through hole 41 are set to be less than or equal to 1.8 μm. More preferably, the arithmetical mean roughnesses of the outer surface 43 and the inner surface 45 of the plug cap 40 and the inner surface 47 of each through hole 41 are set to be less than or equal to 0.8 μm. The roughnesses of the outer surface 43 and the inner surface 45 of the plug cap 40 are those in regions excluding the welded portion 49.

In response to a valve operation of the engine 1 (see FIG. 1), combustible air-fuel mixture flows into the plug cap 40 of the spark plug 10, which is attached to the engine 1, from the combustion chamber 3 through the through holes 41. The spark plug 10 causes a discharge between the center electrode 13 and the ground electrode 30 to create a flame kernel in the spark gap 33. When the flame kernel grows, the combustible air-fuel mixture in the plug cap 40 is ignited and combusted. The combustion generates an expansion pressure so that the spark plug 10 injects a gas flow including flame into the combustion chamber 3 through each through hole 41. The combustible air-fuel mixture in the combustion chamber 3 is combusted by the injected flow of flame.

The spark plug 10 is configured such that the inner surface 45 of the plug cap 40 in a region in front of the back end 34 of the end portion 31 of the ground electrode 30 and the inner surface 47 of each through hole 41 each have an arithmetical mean roughness of less than or equal to 6.3 μm. Therefore, variation in disruption of the flow of the combustible air-fuel mixture that enters the plug cap 40 from the combustion chamber 3 along the inner surface 47 of each through hole 41, flows along the inner surface 45 of the plug cap 40, and reaches the spark gap 33 can be reduced. Accordingly, the combustible air-fuel mixture easily flows through the through holes 41 from the combustion chamber 3 and reaches the spark gap 33 as designed, which facilitates the growth of the flame kernel generated in the spark gap 33. Therefore, the combustible air-fuel mixture can be ignited as designed.

Since the cross-sectional area of the pre-chamber 42 surrounded by the inner surface 45 of the plug cap 40 along a plane perpendicular to the axial line O increases with increasing distance in the direction from front to back, the flow rate of the combustible air-fuel mixture that has flowed into the plug cap 40 from the combustion chamber 3 is lower in a region around the back end portion 48 than in a region around the front end of the plug cap 40. Since the degree of disruption of a flow decreases as the flow rate decreases, the variation in the disruption of the combustible air-fuel mixture that flows through the spark gap 33 can be further reduced. As a result, the growth of the flame kernel generated in the spark gap 33 can be facilitated.

Since the outer surface 43 of the plug cap 40 in a region excluding the welded portion 49 between the metal shell 20 and the plug cap 40 has an arithmetical mean roughness of less than or equal to 6.3 μm, the variation in the disruption of the flow of the combustible air-fuel mixture that flows along the outer surface 43 of the plug cap 40 and enters the through holes 41 from the combustion chamber 3 can be reduced. As a result, the variation in the disruption of the flow of the combustible air-fuel mixture that flows through the through holes 41 and reaches the spark gap 33 can be further reduced. This further facilitates the growth of the flame kernel generated in the spark gap 33.

Figure 4:
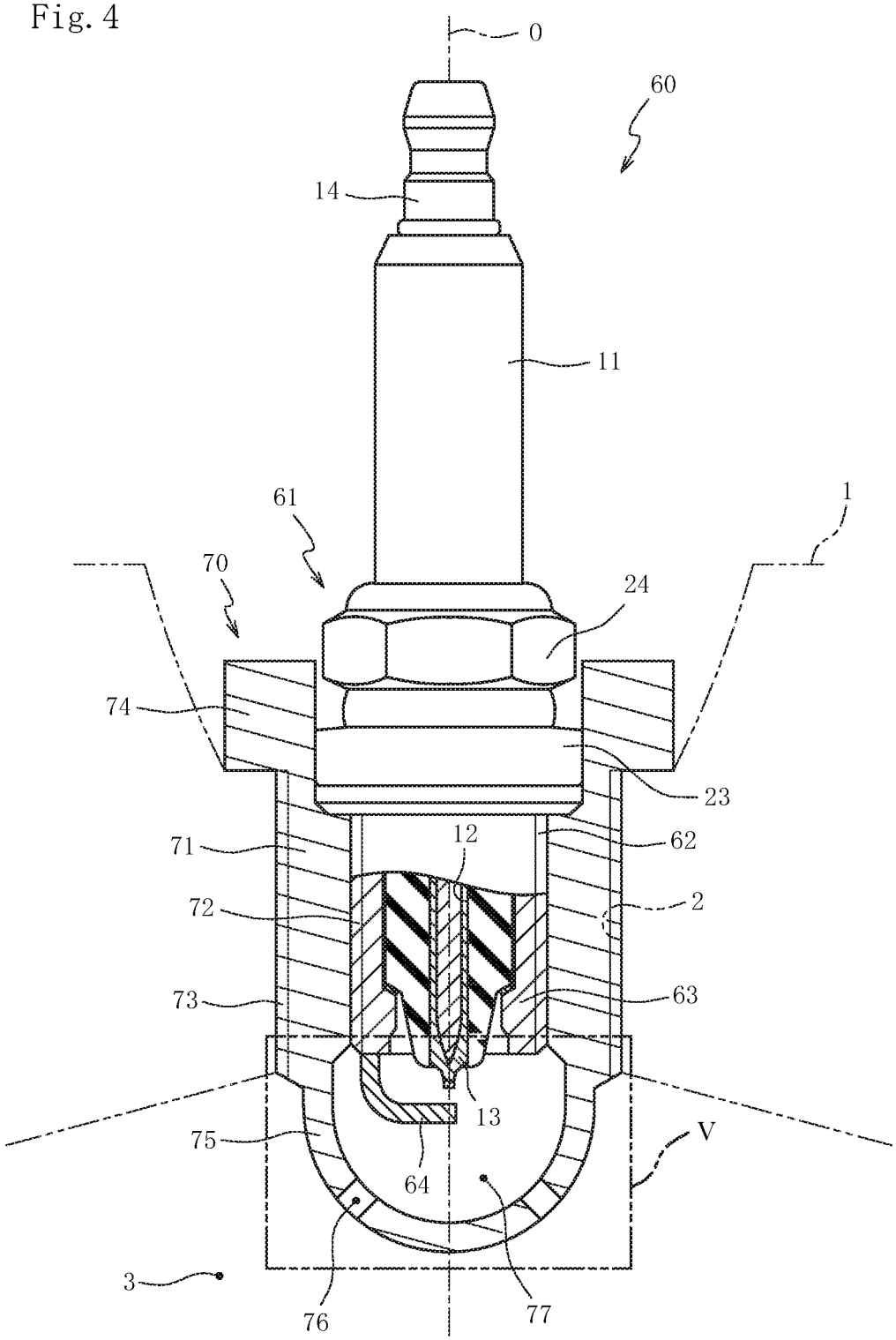
FIG. 4 is a partially sectioned view of a spark plug according to a second embodiment.
Figure 5:
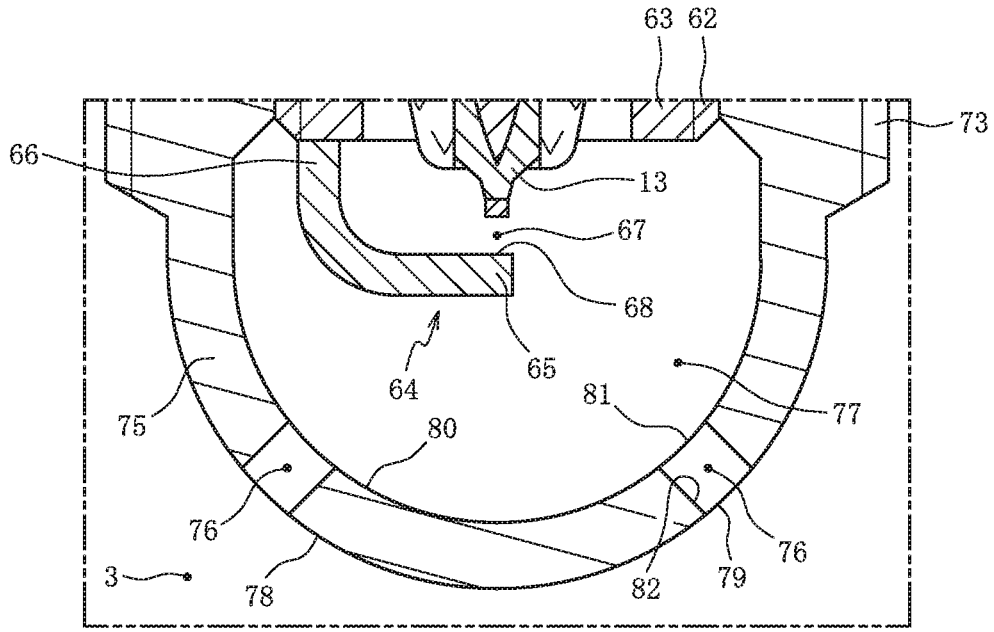
FIG. 5 is an enlarged sectional view of part V of the spark plug shown in FIG. 4.

A second embodiment will be described with reference to FIGS. 4 and 5. In the first embodiment, the plug cap 40 is welded to the metal shell 20. In the second embodiment, a tubular member 70 having a plug cap 75 at the front end thereof is connected to a metal shell 61. Components that are the same as those described in the first embodiment are denoted by the same reference signs, and description thereof is omitted. FIG. 4 is a partially sectioned view of a spark plug 60 according to a second embodiment, and FIG. 5 is an enlarged sectional view of part V of the spark plug 60 shown in FIG. 4.

The spark plug 60 includes the insulator 11, the center electrode 13, the metal shell 61, a ground electrode 64, and the plug cap 75. The metal shell 61 is a substantially cylindrical member made of a conductive metal material (for example, low-carbon steel). The metal shell 61 includes a front end portion 63 having an external thread 62 formed on an outer peripheral surface thereof. The seating portion 23 and the tool engagement portion 24 are provided behind the front end portion 63. The ground electrode 64 is a rod-shaped member made of a metal material containing, for example, Pt, Ni, or Ir as a main component. In the present embodiment, the ground electrode 64 is disposed in front of the external thread 62 of the front end portion 63. One end portion 65 (see FIG. 5) of the ground electrode 64 faces the center electrode 13.

The tubular member 70 has a tubular shape with a closed front end, and includes a body portion 71, a flange portion 74 that is adjacent to and behind the body portion 71, and the plug cap 75 that is adjacent to and in front of the body portion 71. The front end portion 63 of the metal shell 61 is disposed in the body portion 71. The body portion 71 has an internal thread 72 on an inner peripheral surface thereof and an external thread 73 on an outer peripheral surface thereof. The internal thread 72 of the body portion 71 engages with the external thread 62 of the metal shell 61. The external thread 73 of the body portion 71 engages with the threaded hole 2 in the engine 1. The outer diameter of the flange portion 74 is greater than the outer diameter of the external thread 73. The seating portion 23 of the metal shell 61 is disposed inside the flange portion 74 in the radial direction.

The plug cap 75 is a portion that covers the center electrode 13 and the end portion 65 of the ground electrode 64 from the front. The plug cap 75 has at least one through hole 76 in a region in front of the ground electrode 64. In the present embodiment, a plurality of through holes 76 are formed in the plug cap 75. When the tubular member 70 of the spark plug 60 is attached to the threaded hole 2 in the engine 1 by screwing the external thread 73 into the threaded hole 2, the plug cap 75 is exposed in the combustion chamber 3 of the engine 1. The through holes 76 connect a pre-chamber 77, which is surrounded by the metal shell 61 and the plug cap 75, to the combustion chamber 3.

As illustrated in FIG. 5, the other end portion 66 of the ground electrode 64 is joined to the front end portion 63 of the metal shell 61 at a position in front of the external thread 62. A spark gap 67 is formed between the end portion 65 of the ground electrode 64 and the center electrode 13. Each through hole 76 has an outer open end 79 in an outer surface 78 of the plug cap 75 and an inner open end 81 in an inner surface 80 of the plug cap 75. The inner surface 80 of the plug cap 75 is spherical-cap-shaped. The inner open end 81 of each through hole 76 is positioned in front of a back end 68 of the end portion 65 of the ground electrode 64. Each through hole 76 has an inner surface 82 that is inclined toward the front in the direction from the inner open end 81 to the outer open end 79.

A portion (front portion) of the inner surface 80 of the plug cap 75 is positioned in front of the back end 68 of the end portion 65 of the ground electrode 64. The portion of the inner surface 80 of the plug cap 75 that is in front of the back end 68 of the end portion 65 of the ground electrode 64 and the inner surface 82 of each through hole 76 each have an arithmetical mean roughness of less than or equal to 6.3 μm. The outer surface 78 of the plug cap 75 in a region in front of the external thread 73 has an arithmetical mean roughness of less than or equal to 6.3 μm. Accordingly, the spark plug 60 of the second embodiment has operational effects similar to those of the spark plug 10 of the first embodiment. As described in the first embodiment, the arithmetical mean roughness is measured on an intersection line between a plane (not shown) parallel to the axial line O and a surface of the plug cap 75.

EXAMPLES

The present invention will now be described in more detail by way of examples. However, the present invention is not limited to these examples.

Samples 1 to 8 having a structure similar to that of the second embodiment were prepared by a tester. The arithmetical mean roughnesses of the inner surface 80 of the plug cap 75, the outer surface 78 of the plug cap 75, and the inner surface 82 of each through hole 76 differed between samples 1 to 8. The arithmetical mean roughnesses of the surfaces of the plug cap 75 were set to different values by changing the size of grains used to polish the inner surface 80 and the outer surface 78 of the plug cap 75 and the inner surface 82 of each through hole 76 or the polishing method for each manufacturing lot. Properties other than the arithmetical mean roughnesses of the surfaces of the plug cap 75, such as the shapes and sizes of the plug cap 75 and the through holes 76, were the same for samples 1 to 8.

The arithmetical mean roughnesses were determined in accordance with JIS B0601:2013 on an intersection line between a plane parallel to the axial line O and a surface of the plug cap 75 by using a non-contact surface roughness measurement device that uses a laser beam. The arithmetical mean roughness of the inner surface 82 of each through hole 76 was determined by using the non-contact surface roughness measurement device that uses a laser beam after cutting each plug cap 75 of the same manufacturing lot along a plane that passes through the outer open end 79 and the inner open end 81 of the through hole 76 so that the inner surface 82 of the through hole 76 appears.

The tester attached each sample to a 4-cylinder direct injection engine with a displacement of 1.6 liters and operated the engine. With regard to the operation conditions of the engine, the engine revolution (per minute) was 1600 rpm, and the load was 480 kPa net mean effective pressure (NMEP). A test was performed in which the pressure in the combustion chamber was detected over 1000 cycles, one cycle being an operation from when the combustible air-fuel mixture is introduced into the combustion chamber of the engine and combusted to when the combustion gas is discharged, to determine the number of cycles in which ignition of the combustible air-fuel mixture failed. This test was performed 5 times for each sample, and an ignition failure rate was determined.

Each sample was graded on a scale of A to G based on the ignition failure rate. Samples were graded G for an ignition failure rate of greater than or equal to 10%, F for an ignition failure rate of greater than or equal to 9% and less than 10%, E for an ignition failure rate of greater than or equal to 8% and less than 9%, D for an ignition failure rate of greater than or equal to 7% and less than 8%, C for an ignition failure rate of greater than or equal to 6% and less than 7%, B for an ignition failure rate of greater than or equal to 5% and less than 6%, and A for an ignition failure rate of less than 5%. Table 1 shows the arithmetical mean roughnesses of the surfaces of the plug caps and grades of the samples.

TABLE 1

| No | Arithmetical Mean Roughness (μm) Inner Surface of Plug Cap | Inner Surface of Through Hole | Outer Surface of Plug Cap | Grade |
|---|---|---|---|---|
| 1 | 6.3 | 6.3 | 12.5 | F |
| 2 | 6.3 | 6.3 | 1.6 | E |
| 3 | 1.6 | 1.6 | 12.5 | E |
| 4 | 0.8 | 0.8 | 12.5 | D |
| 5 | 0.8 | 0.8 | 6.3 | C |
| 6 | 0.8 | 0.8 | 1.6 | B |
| 7 | 0.8 | 0.8 | 0.8 | A |
| 8 | 12.5 | 12.5 | 12.5 | G |

As is clear from Table 1, Sample 8, in which the inner surface 80 and the outer surface 78 of the plug cap 75 and the inner surface 82 of each through hole 76 had an arithmetical mean roughness of 12.5 μm, was graded G. In contrast, Sample 1, in which the inner surface 80 of the plug cap 75 and the inner surface 82 of each through hole 76 had an arithmetical mean roughness of 6.3 μm and in which the outer surface 78 of the plug cap 75 had an arithmetical mean roughness of 12.5 μm, was graded F. This shows that the occurrence of ignition failure can be reduced when the arithmetical mean roughnesses of the inner surface 80 of the plug cap 75 and the inner surface 82 of each through hole 76 are less than or equal to 6.3 μm.

Comparing Sample 1 with Sample 2, Sample 2, in which the inner surface 80 of the plug cap 75 and the inner surface 82 of each through hole 76 had an arithmetical mean roughness of 6.3 μm and in which the outer surface 78 of the plug cap 75 had an arithmetical mean roughness of 1.6 μm, was graded E. This shows that the occurrence of ignition failure can be further reduced when the arithmetical mean roughness of the outer surface 78 of the plug cap 75 is less than or equal to 1.6 μm.

Comparing Sample 1 with Sample 3, Sample 3, in which the inner surface 80 of the plug cap 75 and the inner surface 82 of each through hole 76 had an arithmetical mean roughness of 1.6 μm and in which the outer surface 78 of the plug cap 75 had an arithmetical mean roughness of 12.5 μm, was graded E. This shows that the occurrence of ignition failure can be further reduced when the arithmetical mean roughnesses of the inner surface 80 of the plug cap 75 and the inner surface 82 of each through hole 76 are less than or equal to 1.6 μm.

Comparing Sample 3 with Sample 4, Sample 4, in which the inner surface 80 of the plug cap 75 and the inner surface 82 of each through hole 76 had an arithmetical mean roughness of 0.8 μm and in which the outer surface 78 of the plug cap 75 had an arithmetical mean roughness of 12.5 μm, was graded D. This shows that the occurrence of ignition failure can be further reduced when the arithmetical mean roughnesses of the inner surface 80 of the plug cap 75 and the inner surface 82 of each through hole 76 are less than or equal to 0.8 μm.

Comparing Sample 4 with Sample 5, Sample 5, in which the inner surface 80 of the plug cap 75 and the inner surface 82 of each through hole 76 had an arithmetical mean roughness of 0.8 μm and in which the outer surface 78 of the plug cap 75 had an arithmetical mean roughness of 6.3 μm, was graded C. This shows that the occurrence of ignition failure can be further reduced when the arithmetical mean roughness of the outer surface 78 of the plug cap 75 is less than or equal to 6.3 μm.

Comparing Sample 5 with Sample 6, Sample 6, in which the inner surface 80 of the plug cap 75 and the inner surface 82 of each through hole 76 had an arithmetical mean roughness of 0.8 μm and in which the outer surface 78 of the plug cap 75 had an arithmetical mean roughness of 1.6 μm, was graded B. This shows that the occurrence of ignition failure can be further reduced when the arithmetical mean roughness of the outer surface 78 of the plug cap 75 is less than or equal to 1.6 μm.

Comparing Sample 6 with Sample 7, Sample 7, in which the inner surface 80 of the plug cap 75, the inner surface 82 of each through hole 76, and the outer surface 78 of the plug cap 75 had an arithmetical mean roughness of 0.8 μm, was graded A. This shows that the occurrence of ignition failure can be further reduced when the arithmetical mean roughness of the outer surface 78 of the plug cap 75 is less than or equal to 0.8 μm.

Although the present invention has been described based on an embodiment, the present invention is not limited to the above-described embodiment in any way, and it can be easily understood that various improvements and modifications are possible within the spirit of the present invention. For example, the shapes of the plug caps 40 and 75 and the numbers, shapes, sizes, etc., of the through holes 41 and 76 are merely examples, and may be set as appropriate.

Although the ground electrode 30 that extends through the front end portion 22 of the metal shell 20 is disposed at a position where the external thread 21 is provided in the first embodiment, the position of the ground electrode is not necessarily limited to this. For example, the plug cap may be disposed such that the front end surface of the front end portion 22 of the metal shell 20 is exposed, and the ground electrode may, of course, be connected to the front end surface of the front end portion 22. The ground electrode may have either a straight shape or a bent shape. The ground electrode may be joined to the plug cap.

Although the internal thread 72 is formed on the inner peripheral surface of the tubular member 70 and the external thread 62 formed on the front end portion 63 is engaged with the internal thread 72 to position the plug cap 75 in front of the metal shell 61 in the second embodiment, means for connecting the tubular member 70 to the metal shell 61 is not limited to this. The tubular member 70 having the plug cap 75 may, of course, be connected to the metal shell 61 by other means. For example, the flange portion 74 of the tubular member 70 and the seating portion 23 of the metal shell 61 may be joined together by, for example, welding. The tubular member 70 may be made of, for example, a metal material, such as a nickel-based alloy, or a ceramic, such as silicon nitride.

Although the inner open ends 46 and 81 of the through holes 41 and 76 appear in cross sections of the plug caps 40 and 75 along a plane including the axial line O in the embodiments, the through holes 41 and 76 are not necessarily limited to this. The through holes 41 and 76 may, of course, be formed in the plug caps 40 and 75 such that positions of the inner open ends 46 and 81 thereof relative to the axial line O are shifted so that the inner open ends 46 and 81 of the through holes 41 and 76 do not appear in cross sections along a plane including the axial line O but appear in cross sections of the plug caps 40 and 75 along a plane parallel to the axial line O.

In the embodiments, the end portions 31 and 65 of the ground electrodes 30 and 64 are disposed in front of the respective center electrodes 13 so that the spark gaps 33 and 67 are formed in front of the center electrodes 13. However, the spark gaps 33 and 67 are not necessarily limited to this. For example, the end portions 31 and 65 of the ground electrodes 30 and 64 may, of course, be disposed to be spaced from side surfaces of the respective center electrodes 13 so that the spark gaps 33 and 67 are formed between the side surfaces of the center electrodes 13 and the end portions 31 and 65 of the ground electrodes 30 and 64. In addition, a plurality of ground electrodes 30 and a plurality of ground electrodes 64 may, of course, be provided to form a plurality of spark gaps 33 and a plurality of spark gaps 67.

What is claimed is:

1. A spark plug comprising:

a metal shell having a tubular shape and extending along an axial line in a direction from front to back;

a center electrode retained in the metal shell in an insulated manner;

a ground electrode electrically connected to the metal shell and disposed such that a spark gap is formed between the center electrode and an end portion of the ground electrode; and a plug cap that covers the center electrode and the end portion of the ground electrode from the front in a region in front of the metal shell and in which a through hole is formed, wherein an inner surface of the plug cap in a region in front of a back end of the end portion of the ground electrode and an inner surface of the through hole each have an arithmetical mean roughness of less than or equal to 6.3 μm.

2. The spark plug according to claim 1, wherein the arithmetical mean roughness of the inner surface of the plug cap and the arithmetical mean roughness of the inner surface of the through hole are less than or equal to 1.6 μm.

3. The spark plug according to claim 1, wherein the arithmetical mean roughness of the inner surface of the plug cap and the arithmetical mean roughness of the inner surface of the through hole are less than or equal to 0.8 μm.

4. The spark plug according to claim 1, wherein the metal shell has an external thread on a back portion of an outer surface of the metal shell and is welded to a back end portion of the plug cap in a region in front of the external thread, and wherein an outer surface of the plug cap in a region excluding a welded portion between the plug cap and the metal shell has an arithmetical mean roughness of less than or equal to 6.3 μm.

5. The spark plug according to claim 1, wherein the plug cap has an external thread on a back portion of an outer surface of the plug cap, and wherein the outer surface of the plug cap in a region in front of a front end of the external thread has an arithmetical mean roughness of less than or equal to 6.3 μm.

6. The spark plug according to claim 4, wherein the arithmetical mean roughness of the outer surface of the plug cap is less than or equal to 1.6 μm.

7. The spark plug according to claim 4, wherein the arithmetical mean roughness of the outer surface of the plug cap is less than or equal to 0.8 μm.

8. The spark plug according to claim 1, wherein the arithmetical mean roughness is measured on an intersection line between a plane parallel to the axial line and a surface of the plug cap.

* * * * *